US006975741B2

(12) United States Patent
Renner

(10) Patent No.: US 6,975,741 B2
(45) Date of Patent: Dec. 13, 2005

(54) ELECTROACOUSTIC TRANSDUCER BEING ACOUSTICAL TIGHT IN THE AREA OF ITS AIR GAP FOR ITS MOVING COIL

(75) Inventor: Heinz Renner, Kaltenleutgeben (AT)

(73) Assignee: Koninklijke Philips Electronics N.V., Eindhoven (NL)

( * ) Notice: Subject to any disclaimer, the term of this patent is extended or adjusted under 35 U.S.C. 154(b) by 303 days.

(21) Appl. No.: 10/240,336

(22) PCT Filed: Feb. 13, 2002

(86) PCT No.: PCT/IB02/00436

§ 371 (c)(1),
(2), (4) Date: Oct. 1, 2002

(87) PCT Pub. No.: WO02/065810

PCT Pub. Date: Aug. 22, 2002

(65) Prior Publication Data

US 2004/0136272 A1 Jul. 15, 2004

(30) Foreign Application Priority Data

Feb. 13, 2001 (EP) ..... 01890035

(51) Int. Cl.[7] ..... H04R 1/00
(52) U.S. Cl. ..... 381/411; 381/407; 381/412
(58) Field of Search ..... 381/396, 400, 381/407, 408, 410, 411, 412, 420, 421, 422

(56) References Cited

U.S. PATENT DOCUMENTS 5,408,533 A * 4/1995 Reiffin ..... 381/407
5,590,211 A * 12/1996 Chang ..... 381/398
6,088,466 A * 7/2000 Proni ..... 381/412
6,359,996 B1 * 3/2002 Ohashi ..... 381/412

FOREIGN PATENT DOCUMENTS

GB 383376 11/1932

* cited by examiner

*Primary Examiner*—Suhan Ni
(74) *Attorney, Agent, or Firm*—Peter Ziowilski

(57) ABSTRACT

A transducer (1) includes a transducer axis (2), a membrane (3), a magnet system (6) having an outer magnet system part (7) and an inner magnet system part (8), a moving coil configuration (27) connected to the membrane (3) and having a coil carrier (28) and a moving coil (29) held by the coil carrier (28) in an air gap (14) between the two magnet system parts (7, 8), and guides (36) for rectilinearly guiding the moving coil configuration (27) parallel to the transducer axis (2). The moving coil configuration (27) has a cylindrical boundary surface (42) which, together with a cylindrical boundary surface (15) of the outer magnet system part (7), delimits a cylindrical gap (43) which is acoustically impermeable above a lower limit frequency of at most 100 Hz.

6 Claims, 2 Drawing Sheets

ELECTROACOUSTIC TRANSDUCER BEING ACOUSTICAL TIGHT IN THE AREA OF ITS AIR GAP FOR ITS MOVING COIL

BACKGROUND OF THE INVENTION

1. Field of the Invention

The invention relates to an electroacoustic transducer having a transducer axis and a membrane, a magnet system including an external magnet system part and an internal magnet system part together enclosing an air gap, a moving coil configuration connected to the membrane and having a coil carrier and a moving coil supported by the coil carrier and held in the air gap, and guide means for guiding the moving coil configuration rectilinearly parallel to the transducer axis.

2. Description of the Related Art

Such an electroacoustic transducer is known from U.K. Patent Specification No. GB 383,376. The hollow cylindrical moving coil in the known transducer lies opposite a cylindrical boundary surface of the outer magnet system part such that there is a relatively large space between the moving coil and the cylindrical boundary surface of the outer magnet system part (there is no information in this patent document on the free contours of the moving coil opposite the bushing-like coil carrier), with the consequence that the gap-like area lying between the moving coil and the boundary surface of the outer magnet system part is acoustically impermeable only to relatively high frequencies, i.e., to frequencies above a range of about 900 Hz to 1100 Hz, whereas this gap-like area is not acoustically impermeable to lower frequencies. As a result, the known electroacoustic transducers are suitable only for achieving a perfect reproduction of signals above a frequency range of about 900 Hz to 1100 Hz, whereas a reproduction of signals of lower frequencies with a satisfactory quality is practically impossible.

SUMMARY OF THE INVENTION

An object of the subject invention is to avoid the circumstances described above and to create an improved electroacoustic transducer.

This object is achieved in an electroacoustic transducer, according to the invention, comprising a transducer axis; a membrane capable of oscillation parallel to the transducer axis; a magnet system comprising an outer magnet system part and an inner magnet system part together enclosing an air gap limited by a cylindrical boundary surface of the outer magnet system part and a cylindrical boundary surface of the inner magnet system part, said magnet system having at least one passage for enabling communication between a rear chamber volume situated directly to the rear of the membrane and an additional rear chamber volume parallel to the direction of the transducer axis and lying remote from the rear of the membrane; a moving coil configuration connected to the membrane having a hollow cylindrical coil carrier and a moving coil of hollow cylindrical shape connected to the coil carrier, said moving coil being retained so as to lie at least substantially in the air gap and being adjustable in relation to the magnet system; and guide means for the moving coil configuration, said guide means guiding the moving coil configuration parallel to the transducer axis upon adjustment of the moving coil in relation to the magnet system, wherein the moving coil configuration has a cylindrical boundary surface in an area of the moving coil configuration lying opposite the cylindrical boundary surface of the outer magnet system part, and wherein the cylindrical boundary surface of the outer magnet system part and the cylindrical boundary surface of the moving coil configuration are arranged so as to be mutually coaxial and delimit a cylindrical gap which is acoustically impermeable above a lower limit frequency of, at most, 100 Hz.

The measures according to the invention, in a constructionally simple manner, provide an electroacoustic transducer in which the cylindrical boundary surface of the moving coil configuration is held at a slight and always constant distance from the cylindrical boundary surface of the outer magnet system part, even during operation of the transducer, while the width of the cylindrical gap formed between the cylindrical boundary surface of the moving coil configuration and the cylindrical boundary surface of the outer magnet system part in the transducer is so small that this cylindrical gap is acoustically impermeable above a lower limit frequency of, at most, 100 Hz, which means that perfect acoustic signal reproduction is guaranteed down to a low frequency of 100 Hz.

In an electroacoustic transducer according to the invention, it has been found to be very advantageous if the cylindrical boundary surface of the outer magnet system part and the cylindrical boundary surface of the moving coil configuration delimit a cylindrical gap which is acoustically impermeable above a lower limit frequency of 50 Hz. This means that a perfect acoustic signal reproduction is guaranteed down to a low frequency of 50 Hz. It has further been found to be particularly advantageous if an acoustically impermeable behavior of the gap above a lower limit frequency of 20 Hz is guaranteed with a correspondingly shaped gap. It should be mentioned that the cylindrical gap can have such a structure, namely, such a gap width and gap length parallel to the transducer axis, that this gap is acoustically impermeable above a lower limit frequency of no more than 10 Hz or even 5 Hz.

In an electroacoustic transducer according to the invention, the moving coil may be embedded in a plastic casing and may be placed with its plastic casing on an outer boundary surface of the hollow cylindrical coil carrier, in which case, the plastic casing has an exactly cylindrical outer boundary surface which forms the cylindrical boundary surface of the moving coil configuration and is arranged opposite the cylindrical boundary surface of the outer magnet system part. It has been, however, found to be particularly advantageous if the cylindrical boundary surface of the moving coil configuration is formed by an outer oundary surface of the hollow cylindrical coil carrier, and the moving coil is provided inside the hollow cylindrical coil carrier and connected to the coil carrier. Such a design has proven to be very advantageous in tests.

In a transducer according to the invention, the guide means may be formed by guide strips and guide grooves running parallel to the transducer axis, these guide strips projecting into the guide grooves. It has been, however, found to be particularly advantageous if the guide means are formed by a ball-bearing configuration which has at least two trough-like ball cages running parallel to the transducer axis, while balls are arranged in two axial levels within the cages. Such a design has proven to be advantageous in view of a rectilinear guidance of the moving coil with maximum ease of movement. Such a design may also be achieved with high precision, which is of great advantage in view of a manufacture of a cylindrical gap which is as narrow as possible and has a uniform width.

In such a ball-bearing configuration, it has been found to be particularly advantageous if the balls are made of a synthetic resin material, for example, polyacetal or polyurethane. Preferably round balls are provided.

It has been found to be particularly advantageous in the electroacoustic transducer according to the invention, if the membrane is connected only to the hollow cylindrical coil carrier of the moving coil configuration. This advantageously means that there is no mechanical connection of any type between the membrane and other transducer parts, as is the case, for example, in the transducer shown in FIG. 4 of U.K. Patent Specification No. GB 383,376 cited above, in which the return means for the moving coil connection is also connected to the membrane. With the design according to the invention, in which the membrane is connected only to the hollow cylindrical coil carrier, practically any low natural resonance frequencies can be advantageously achieved by the assembly formed from the membrane and moving coil configuration, which benefits a high quality reproduction of signals at low frequency.

The above and further aspects of the invention will become evident from the embodiment described below and will be explained with reference to this embodiment.

BRIEF DESCRIPTION OF THE DRAWINGS

The invention will be described below with reference to an embodiment shown in the drawings, in which.

DESCRIPTION OF THE PREFERRED EMBODIMENTS

Figure 1:
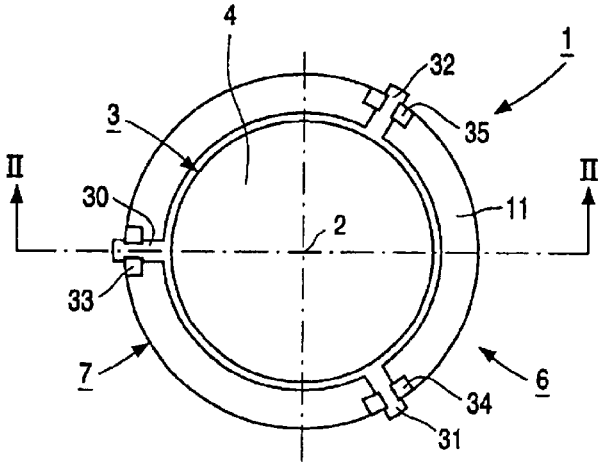
FIG. 1 shows, in plan view, an electroacoustic transducer according to an embodiment of the invention.

FIGS. 1 to 4 show an electroacoustic transducer 1. The electroacoustic transducer 1 in this case is an electrodynamic loudspeaker. The special features of this electrodynamic loudspeaker are that this speaker has small external dimensions, i.e., an overall external diameter in the range of around 20 to 25 mm, and that this speaker, despite its small size, has a particularly high reproduction quality, i.e., hi-fi reproduction quality, and that it is also achieved, with this speaker, that very low frequencies, which lie in the range between 20 and 50 Hz, can be reproduced by this speaker with an excellent quality.

The transducer 1 has a transducer axis 2 and is fitted with a membrane 3 capable of oscillation parallel to the transducer axis 2. The membrane 3 is mainly cup- or dome-like and has a cupor dome-like portion 4 and a hollow cylindrical fixing portion 5 projecting from the portion 4 parallel to the transducer axis 2.

The transducer 1 is also fitted with a magnet system 6. The magnet system 6 has an outer magnet system part 7 and an inner magnet system part 8, as well as a permanent magnet 9. The outer magnet system part 7 is pot-shaped and has a base wall 10 and a hollow cylindrical side wall 11. The inner magnet system part 8 is also pot-shaped and has a base wall 12 and a hollow cylindrical side wall 13. The permanent magnet 9 has a circular disc-like structure and is provided between the base wall 10 of the outer magnet system part 7 and the base wall 12 of the inner magnet system part 8. The two magnet system parts 7 and 8 are made of a magnetically highly permeable material, preferably soft iron.

The two magnet system parts 7 and 8 enclose an air gap 14 in the area of the two side walls 11 and 13. The air gap 14 is limited by a cylindrical boundary surface 15 of the outer magnet system part 7 and a cylindrical boundary surface 16 of the inner magnet system part 8.

Figure 2:
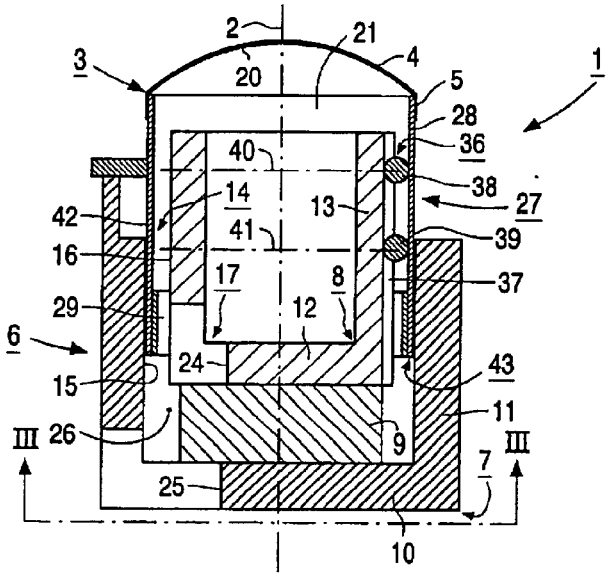
FIG. 2 shows, in a section taken on the line II—II in FIG. 1, a cross-section of an elevational view of the electroacoustic transducer of FIG. 1.
Figure 3:
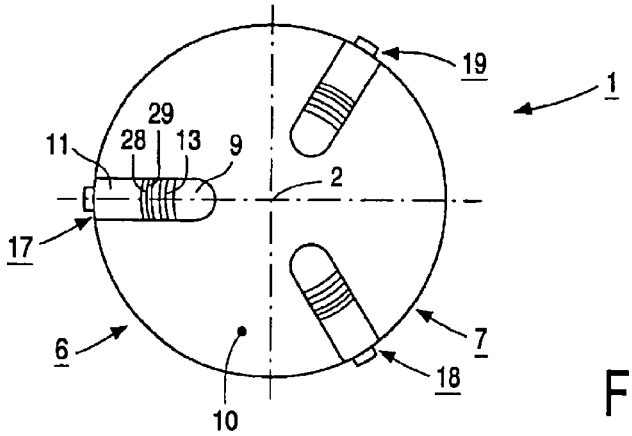
FIG. 3 is a bottom view, from the perspective of the line III—III in FIG. 2, of the electroacoustic transducer of FIG. 1.
Figure 4:
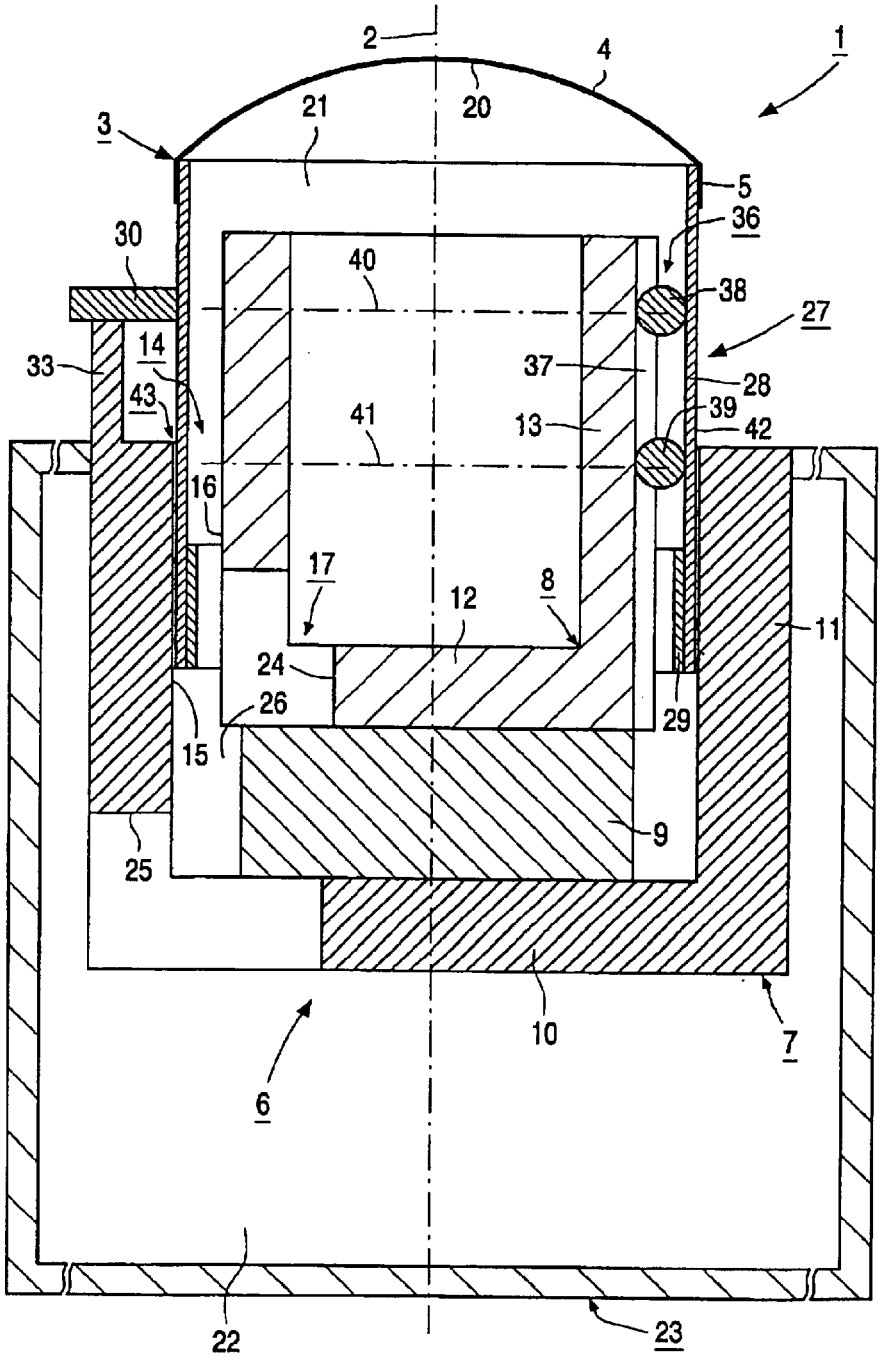
FIG. 4 shows, in a manner similar to that of FIG. 2, but on a larger scale, the electroacoustic transducer of FIGS. 1–3 in which the electroacoustic transducer is held in a housing.

As regards the magnet system 6, it should be kept in mind that the magnet system 6 in the present case has three passages 17, 18 and 19 for enabling communication between a rear chamber volume 21, situated directly to the rear 20 of the membrane 3, and an additional rear chamber volume 22 lying remote from the rear 20 of the membrane 3 parallel to the direction of the transducer axis 2. The additional rear chamber volume 22 is, as is evident from FIG. 4, limited by a housing 23 which is not shown with its full dimensions in directions transverse to transducer axis 2 in FIG. 4. As is apparent from FIGS. 2 and 4 showing the passage 17, each of the three passages 17, 18 and 19 consists of a slot-like opening 24 in the inner magnet system part 8 and a corresponding slot-like opening 25 in the outer magnet system part 7, these two openings 24 and 25 being inter-connected via an intermediate chamber 26 lying adjacent the permanent magnet 9 and being, accordingly, allocatable to a passage 17 or 18 or 19. The three passages 17, 18 and 19 thus serve to enlarge the rear chamber volume 21 situated directly to the rear 20 of membrane 3 by the additional rear chamber volume 22, which is necessary if a perfect-quality acoustic reproduction of signals with low frequencies in a frequency range between 20 Hz and a few 100 Hz is to be guaranteed.

The transducer 1 is also fitted with a moving coil configuration 27. The moving coil configuration 27 is connected to the membrane 3. The moving coil configuration 27 has a hollow cylindrical coil carrier 28 formed by a plastic bush. Furthermore, the moving coil configuration 27 has a hollow cylindrical moving coil 29 connected to the cylindrical coil carrier 28. The moving coil 29 is held so as to lie fully in the air gap 14. The moving coil 29 is adjustable in relation to the magnet system 6. When the transducer 1 is operated, the moving coil 29 is supplied with electric signals with the result that the moving coil 29 is set in oscillation in relation to the magnet system 6 in accordance with the signals supplied and parallel to the direction of the transducer axis 2, these oscillations being converted into sound waves by the membrane 3.

FIGS. 2 and 4 show the moving coil configuration 27 in a home position. The home position of the moving coil configuration 27 is defined in that the coil carrier 28 is connected to three rubber webs 30, 31 and 32 which, in the area of their free ends, are connected to retaining blocks 33, 34 and 35 projecting from the side wall 11 of the outer magnet system part 7 parallel to the direction of the transducer axis 2. The rubber webs 30, 31 and 32 offer the advantage that practically always the same return forces are exerted on the moving coil configuration 27, both in the case of a positive deflection from the home position shown in FIGS. 2 and 4 and in the case of a negative deflection. The rubber webs 30, 31 and 32 are thus used not only to define the home position of the moving coil configuration 27 but also as a means for returning the moving coil configuration 27 to its home position. It should be noted that the home position of the moving coil configuration 27 may alternatively be established in another manner, for example, through the use of helically wound compression springs or leaf springs or other springs, but also without mechanical aids, for example, by using return means in which magnetic return forces are utilized. It is also conceivable to achieve the return function with the use of the magnet system 6 of the transducer 1 which is present in any case.

The transducer 1 also has guide means 36 for the moving coil configuration 27. The guide means 36 guide the moving coil configuration 27 exactly parallel to the transducer axis 2 during an adjustment of the moving coil 29 in relation to the magnet system 6. The guide means 36 in the transducer 1 are formed by a ball-bearing configuration 36 which, in the present case, has three groove-type ball cages 37 running parallel to the transducer axis 2, only one of the ball cages 37 being shown in FIGS. 2 and 4. Furthermore, the ball-bearing configuration 36 has balls 38 and 39 which enter the ball cages 37 and are arranged at two axial levels indicated with dotted lines 40 and 41. The transducer 1 thus has a total of six such balls 38 and 39, of which only two of the balls 38 and 39 are shown in FIGS. 2 and 4.

The transducer 1 is advantageously structured such that the moving coil configuration 27 has a cylindrical boundary surface 42 in its area lying opposite the cylindrical boundary surface 15 of the outer magnet system part 7, and the cylindrical boundary surface 15 of the outer magnet system part 7 and the cylindrical boundary surface 42 of the moving coil configuration 27 are arranged so as to be mutually coaxial, defining a cylindrical gap 43 therebetween. The cylindrical gap 43 has a gap width in the radial direction and a gap length parallel to the transducer axis 2 such that these two gap dimensions guarantee that the gap 43 is acoustically impermeable above a lower limit frequency of around 20 Hz, i.e., the gap 43 has an acoustically impermeable behavior.

In a sample of the transducer 1 constructed during development, a cylindrical gap 43 was produced, the gap width having a value of approximately 0.1 mm and the gap length having a value of approximately 10 mm. However, further samples were also manufactured in which the cylindrical gap 43 was made substantially narrower, for example, 0.05 mm, and also 0.02 mm to 0.01 mm. Despite these very narrow gaps 43, and because of the precise linear guidance of the moving coil configuration 27 by the ball-bearing configuration 36 parallel to the transducer axis 2, no serious problems were ever encountered with regard to an undesirable knocking of the moving coil configuration 27 against the cylindrical boundary surface 15 of the outer magnet system part 7. As a result of the small gap width of the cylindrical gap 43, this gap 43 is effectively acoustically impermeable down to very low limit frequencies, which is an extremely important condition for enabling a perfect acoustic reproduction of low frequency signals.

The cylindrical boundary surface 42 of the moving coil configuration 27 in the transducer 1 is formed by the outer boundary surface of the hollow cylindrical coil carrier 28, which has the advantage that the cylindrical boundary surface 42 of the moving coil configuration 27 is realized with an exactly constant diameter over its entire axial dimension because the cylindrical boundary surface 42 is determined only by a single component, i.e., the coil carrier 28.

The transducer 1 has the further advantage that the moving coil 29 is provided inside the hollow cylindrical coil carrier 28 and is connected to the coil carrier 28 inside the coil carrier 28. Connecting the moving coil 29 to the coil carrier 28 is here achieved by means of an adhesive joint (not shown). The connection, however, may alternatively be achieved in a different manner.

With regard to the gap length running parallel to the transducer axis 2 of the cylindrical gap 43, it is to be noted that this gap length is sufficiently large to guarantee an acoustically impermeable behavior of the gap 43, even in the case in which the moving coil configuration 27 is in its extreme stroke position lying furthest away from the base wall 10 of the outer magnet system part 7.

The membrane 3 of the transducer 1 is connected only to the hollow cylindrical coil carrier 28 of the moving coil configuration 27 by means of the hollow cylindrical fixing portion which projects from the oscillation portion 4 of the membrane 3 parallel to the transducer axis 2 and is placed on the coil carrier 28 and connected to the coil carrier 28 by means of an adhesive joint. Consequently there is no mechanical connection between the membrane and parts other than the coil carrier 28, which is particularly advantageous because, as a result, practically any low resonance frequencies of the component consisting of the membrane 3 and moving coil configuration 27 can be achieved.

In the transducer 1 according to the invention:

1) the acoustic impermeability necessary in such a transducer 1 between the area lying in front of the membrane 3 and the area lying behind the membrane 3;
2) the precise axial guidance of the moving coil configuration 27; and
3) the return of the moving coil configuration 27 are each achieved in a constructionally simple and reliable manner by three independent means, which offers the major advantage that each of these means can be dimensioned and structured independently of the each other, so that optimum conditions can be created for each of the functions to be achieved by these means. The transducer 1 according to the invention is therefore ideally suited for large membrane strokes while simultaneously guaranteeing a high transfer linearity.

It should be noted that the coil carrier 28 and the moving coil 29 of the moving coil configuration 27 in the transducer 1 of FIGS. 1 to 4 are formed by two separately manufactured parts connected together after manufacture. It is alternatively possible to produce and structure a moving coil configuration 27 such that the moving coil configuration 27 has a moving coil 29 which is first wound alone as a freestanding coil, whereupon this moving coil 29 is connected to the coil carrier 28 formed by molding around the moving coil 29, in which case, the coil carrier 28 will be formed substantially longer than the axial dimension of the moving coil 29 and thus, in the same way as the transducer 1 described above with reference to FIGS. 1 to 4, can be guided by means of a ball-bearing configuration.

It should be noted that the transducer 1 of FIGS. 1 to 4 has the cylindrical boundary surface 15 of the outer magnet system part 7 and the cylindrical boundary surface 16 of the inner magnet system part 8 and the cylindrical boundary surface 42 of the moving coil configuration 27 and the hollow cylindrical gap 43. Preferably, this is a circular cylindrical design, but this is not absolutely essential, as the cylindrical design need not necessarily have a circular shape as its base surface, but may alternatively have a square or triangular or polygonal shape as its base surface.

Roller bearings may be used as the guide means instead of a ball-bearing configuration.

What is claimed is:

1. An electroacoustic transducer comprising:

a transducer axis;

a membrane capable of oscillation parallel to the transducer axis;

a magnet system comprising an outer magnet system part and an inner magnet system part said outer and inner magnet system parts enclosing an air gap limited by a cylindrical boundary surface of the outer magnet system part and a cylindrical boundary surface of the inner magnet system part, said magnet system having at least one passage for enabling communication between a rear chamber volume, situated directly to the rear of the membrane, and an additional rear chamber volume lying remote from the rear of the membrane and parallel to the direction of the transducer axis;

a moving coil configuration connected to the membrane and having a hollow cylindrical coil carrier and a moving coil of hollow cylindrical shape connected to the hollow cylindrical coil carrier, said moving coil being retained so as to lie at least substantially in the air gap, and being adjustable in relation to the magnet system; and guide means for guiding the moving coil configuration in a direction parallel to the transducer axis upon adjustment of the moving coil in relation to the magnet system, wherein the moving coil configuration has a cylindrical boundary surface in an area lying opposite the cylindrical boundary surface of the outer magnet system part, and the cylindrical boundary surface of the outer magnet system part and the cylindrical boundary surface of the moving coil configuration are arranged to be mutually coaxial and delimit a cylindrical gap which is acoustically impermeable above a lower limit frequency of, at most, 100 Hz.

2. The electroacoustic transducer as claimed in claim 1, wherein the cylindrical boundary surface of the outer magnet system part and the cylindrical boundary surface of the moving coil configuration delimit a cylindrical gap which is acoustically impermeable above a lower limit frequency of, at most, 50 Hz.

3. The electroacoustic transducer as claimed in claim 2, wherein the cylindrical boundary surface of the outer magnet system part and the cylindrical boundary surface of the moving coil configuration delimit a cylindrical gap which is acoustically impermeable above a lower limit frequency of maximum 20 Hz.

4. The electroacoustic transducer as claimed in claim 1, wherein the cylindrical boundary surface of the moving coil configuration is formed by an outer boundary surface of the hollow cylindrical coil carrier, and wherein the moving coil is provided inside the hollow cylindrical coil carrier and is connected to said hollow cylindrical coil carrier (28).

5. The electroacoustic transducer as claimed in claim 1, wherein the guide means is formed by a ball-bearing configuration having at least two groove-type ball cages running parallel to the transducer axis and balls positioned within said ball cages, said balls being arranged at two axial levels.

6. The electroacoustic transducer as claimed in claim 1, wherein the membrane is connected only to the hollow cylindrical coil carrier of the moving coil configuration.

* * * * *